US006929117B1

(12) United States Patent
Cohen

(10) Patent No.: US 6,929,117 B1
(45) Date of Patent: Aug. 16, 2005

(54) ONE PIECE ADJUSTABLE SIZE BROCHURE HOLDER

(76) Inventor: Daniel A. Cohen, 40 Welisewitz Rd., Ringoes, NJ (US) 08551

( * ) Notice: Subject to any disclaimer, the term of this patent is extended or adjusted under 35 U.S.C. 154(b) by 0 days.

(21) Appl. No.: 10/832,081

(22) Filed: Apr. 26, 2004

(51) Int. Cl.[7] ..... B65D 5/52
(52) U.S. Cl. ..... 206/45.25; 206/425; 211/50
(58) Field of Search ..... 206/45.24–45.26, 206/425, 449, 806; 211/48, 49.1, 50, 72, 73; 220/480; 248/460, 463, 174; 229/120.08, 120.17, 120.18, 120.19, 164

(56) References Cited

U.S. PATENT DOCUMENTS

| | | | | | |
|---|---|---|---|---|---|
| 366,906 | A | | 2/1887 | Taylor | |
| 366,907 | A | | 2/1887 | Taylor | |
| 419,350 | A | | 1/1890 | Baron | |
| 2,716,485 | A | * | 8/1955 | Hecker | 206/45.25 |
| 4,311,233 | A | * | 1/1982 | Austin | 206/45.25 |
| 4,579,232 | A | * | 4/1986 | Fedak | 206/45.25 |
| 4,630,731 | A | | 12/1986 | Albery | |
| 4,819,792 | A | | 4/1989 | Christian | |
| 5,046,273 | A | | 9/1991 | Virvo | |
| 5,150,813 | A | * | 9/1992 | Harris et al. | 206/45.26 |
| 5,156,265 | A | * | 10/1992 | Platt | 206/45.25 |
| 5,301,800 | A | | 4/1994 | Kenney | |
| 5,351,882 | A | * | 10/1994 | Krautsack | 206/45.26 |
| 5,630,546 | A | | 5/1997 | Velch | |

* cited by examiner

*Primary Examiner*—Luan K. Bui
(74) *Attorney, Agent, or Firm*—Kenneth P. Glynn

(57) ABSTRACT

The brochure holder includes a plurality of panels that are cut into a single flat unit, and are folded and assembled. A first back panel has a front surface, a back surface, two sides, a top and a bottom. A first side panel is connected at its first side to a side of the first back panel. A front panel has a first side that is connected to the second side of the first side panel. A second side panel has a first side that is connected to the second side of the front panel. A second back panel has a first side that is connected to the second side of the second side panel. A bottom panel is connected to one of the above panels, and has an extended vertical flap adapted to be positioned vertically upwardly at about 90° from the bottom panel, and the vertical flap has a divider lock mechanism formed thereon. There is a brochure compartment divider located on the first back panel. It has a first position, which is a closed position, in the same plane as a back panel on which it is located, so as to create a single brochure holder compartment, and a second position, being an opened position, in a plane approximately at about 90° to a back panel on which it is located, and when in the second position, it is fitted into the divider lock mechanism of the vertical flap so as to create two brochure holder compartments.

20 Claims, 7 Drawing Sheets

ONE PIECE ADJUSTABLE SIZE BROCHURE HOLDER

BACKGROUND OF THE INVENTION

1. Field of the Invention

The present invention relates to brochure holders, and especially adjustable brochure holders that may be converted from a single to a double pocket holder. Also, it is a single piece item so that no components may be lost or misplaced, and conversion is easy.

2. Information Disclosure Statement

The following patents are representative prior art for brochure holders:

U.S. Pat. No. 4,630,731 describes a preformed plastic blank and a brochure holder assembled therefrom. The holder includes a front panel with an adjoining bottom panel and two adjoining side panels. Adjoining each side panel is a back panel. Each panel has a raised center portion to provide for enhanced torsional rigidity, and the adjoining panels have perforations at their common edges. To facilitate access to the brochures, the bottom panel has an inclined surface formed therein sloping downward from the rear of the holder toward the front to urge any brochures held therein towards the front of the holder. The assembled blank is held together by complementary projecting hollow fingers and cavities formed on the marginal portions of the back panels and a flap pending from the bottom panel.

U.S. Pat. No. 4,819,792 describes a counter or wall display for cards or brochures, made from a single stamping which is die-cut to define both the perimeter of the unit and at the same time stamp score lines partially through the material to define the hinge lines. The score lines divide the single sheet into connected front, floor and rear panels, and a pair of side panels which hinge rearwardly from the front panel and have edges which interlock with the edges of the rear panel, so that an open-topped box display is formed from a single sheet of planar stock with no fasteners whatsoever.

U.S. Pat. No. 5,046,273 describes a collapsible, illuminated, graphic display device designed to display graphic advertising messages which may be interchanged. In addition to holding the messages, the front panel contains pockets to hold materials such as brochures and business cards for distribution. It further contains a slotted arrangement to receive messages or business cards. The device may be employed for a tabletop display and has triangular sides to hold the viewing panel at an optimum angle for observation.

U.S. Pat. No. 5,301,800 describes a literature holder formed from a flat blank by folding forwardly side panels attached on each side of a back panel. A foot portion is connected on the bottom end of each side panel and is formed by a cut in the blank extending inwardly from the folding line, which terminates at the upper side of the cut, downwardly toward a lower end of the back panel, so that when the side panel is swung forwardly, the foot portion swings rearwardly about the axis of the folding line. At each side, the lower edge of the side panel and its foot portion inclines upwardly inwardly so that, in the erected state, the back panel inclines rearwardly upwardly when the forwardly projecting side panel and rearwardly projecting foot portion are placed on a flat surface. A front panel and a bottom panel bridge the front and bottom edges of the side panels, respectively, forming a compact, stable and efficient holder.

U.S. Pat. No. 5,630,546 describes a point of sale display system that comprises a printed poster having a novel brochure holder attached to one face thereof. The poster is itself supported in a vertically upright condition by a rigid backing member and a stake or post. The brochure holder is provided in an unassembled form using a single piece of plastic material that is cut and scored to be capable of being bent and assembled into a three dimensional assembled form. When so assembled, the brochure holder comprises a lightweight, upright body having an upwardly facing brochure holding cavity. The body is closed by a pivotal top cover that may be releasably secured to the body by a hook and pile fastening system.

U.S. Pat. No. Des. 366,906 illustrates a brochure holder in a triangular array with twelve small size brochure pockets.

U.S. Pat. No. Des. 366,907 illustrates a brochure holder in a triangular array with six brochure pockets.

U.S. Pat. No. Des. 419,350 illustrates an upright brochure holder with an open front.

Notwithstanding the prior art, the present invention is neither taught nor rendered obvious thereby.

SUMMARY OF THE INVENTION

The present invention relates to a one piece, adjustable size brochure holder. It is designed to be convertible from single to multiple compartments, and is made of a single cutting of construction material, preventing loss or misplacement of components and ease of use. The present invention brochure holder includes a plurality of panels that are cut into a single flat unit, and are folded and assembled. The panels include:

A first back panel has a front surface, a back surface, two sides, a top and a bottom. A first side panel, having a front surface, a back surface, a first side and a second side, a top and a bottom, is connected at its first side to a side of the first back panel. A front panel has a front surface and a back surface, a first side and a second side, a top and bottom, wherein the first side of the front panel is connected to the second side of the first side panel. A second side panel has a front surface, a back surface, a first side and a second side, a top and a bottom, wherein the second side panel is connected at its first side to the second side of the front panel. A second back panel has a front surface, a back surface, a first side and a second side, a top and a bottom, wherein the second back panel is connected at its first side to the second side of the second side panel. A bottom panel is connected to one of the first back panel, the first side panel, the front panel, the second side panel, and the second back panel at its bottom, the bottom panel has an extended vertical flap adapted to be positioned vertically upwardly at about 90° from the bottom panel, and the vertical flap has a divider lock mechanism formed thereon. There is a brochure compartment divider located on and partially cut from one of the first back panel and the second back panel. The brochure compartment divider has a first position, which is a closed position, in the same plane as a back panel on which it is located, so as to create a single brochure holder compartment, and a second position, being an opened position, in a plane approximately at about 90° to a back panel on which it is located, and when in the second position, it is fitted into the divider lock mechanism of the vertical flap so as to create two brochure holder compartments, wherein the first back panel and the second back panel may be brought to coincide against one another, and the bottom may be attached to at least one of the first back panel, the first side panel, the front panel, the second side panel, and the second bottom panel to create an open top brochure holder, and wherein the brochure compartment divider may be in the first position such that the brochure holder may accommodate a single stack of brochures, and wherein the brochure compartment divider may be in the second position such that the brochure holder may accommodate side-by-side separate stacks of brochures.

In some preferred embodiments of the present invention one piece, adjustable size brochure holder, the brochure compartment divider is located on said first back panel.

Further, the second back panel may contain a partially cut pull-out support stand, so that the brochure holder may be set upright on a horizontal surface, such as a table, and be stable with contents being inserted and removed. Alternatively, or in addition, the present invention brochure holder back panels may include a mounting mechanism for hanging the brochure holder on a vertical surface, such as a hook, mounting tape, or orifices for nail or hook mounting.

In some embodiments, the bottom panel may be connected to one of the first back panel, front panel, and second back panel. In some embodiments, in addition to the aforesaid bottom panel, a separate second bottom panel may be included, wherein the first bottom panel is connected to one of the first back panel and the second back panel, and the second bottom panel is connected to the front panel. Also, in some embodiments, the first side panel and the second side panel may each include bottom flaps connected thereto.

In some preferred embodiments of the present invention one piece, adjustable size brochure holder, the first back panel and the second back panel may include complementary interconnecting components for attachment to one another. These complementary interconnecting components may, for example, be a tab and receiving slot.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
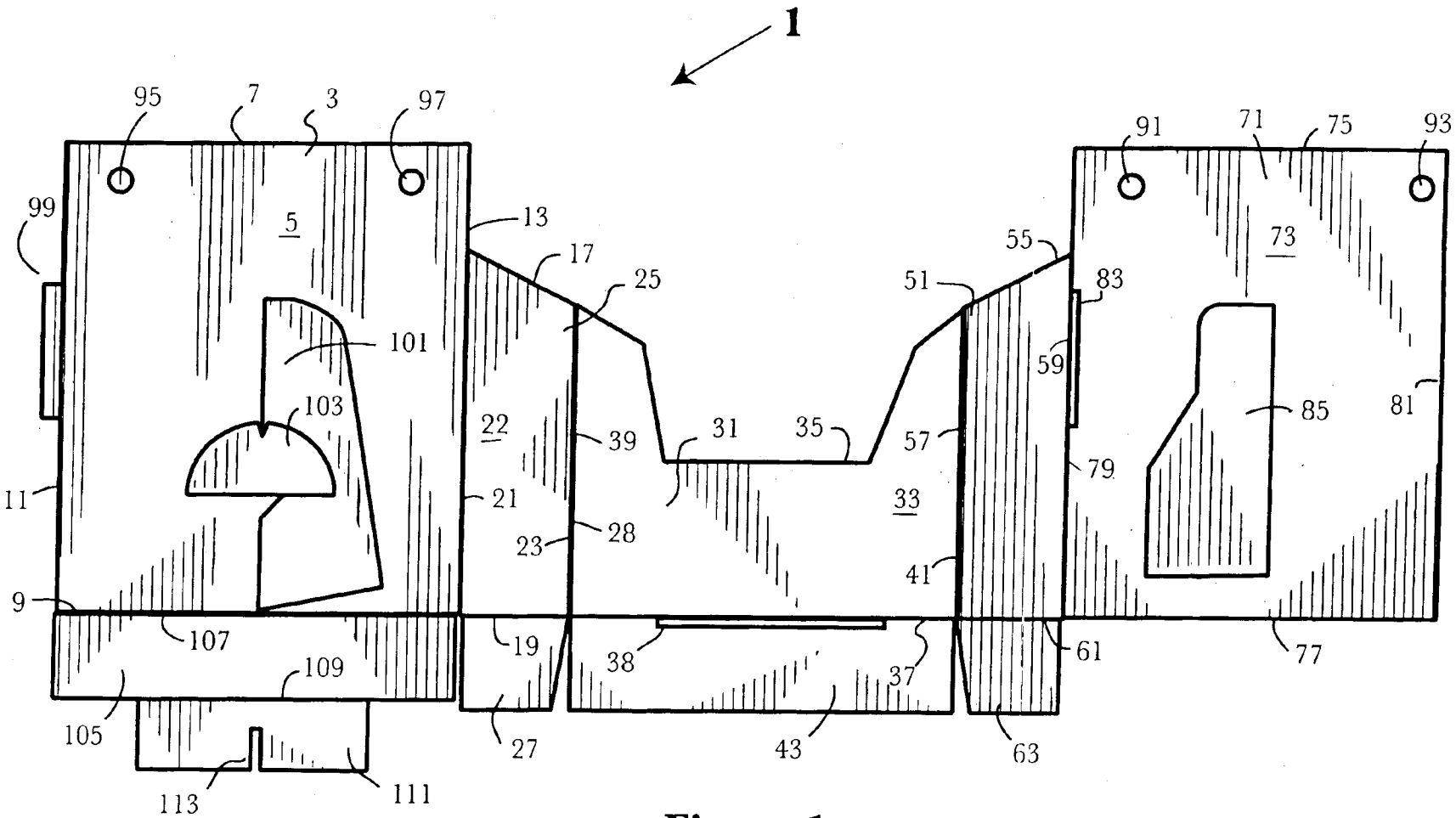
FIG. 1 shows a front open view of a preferred embodiment of a present invention one piece adjustable size brochure holder.

FIG. 1 shows a front flat view of present invention one piece, adjustable size brochure holder 1. It includes a first back panel 3 that includes a front surface (in this figure, facing into the board), a back surface 5, a first side 13, a second side 11, a top 7 and a bottom 9. First side 13 is foldably connected to first side panel 25 at first side panel first side 21. First side panel 25 has a front 22 and a back (not shown), a top 17, a bottom 19 and a second side 28. It has a flap 27 located at its bottom 19. Second side 28 of first side panel 25 is connected to a front panel 31 at a front panel first side 39. Front panel 31 has a front 33, a back (not shown), first side 39 and second side 41. Bottom 37 has a receiving slot 38 and second flap 43.

First back panel 3 has a bottom panel 105 with a top 107 and a bottom 109. It is connected to bottom panel 9 of first back panel 3 at its top 107 and has a tongue flap 111 connected to its bottom 109. When assembled, tongue flap 111 is inserted into slot 38, as is illustrated in the FIGS. 2 and 3 below. Tongue flap 111, when fully inserted into slot 38 will be positioned vertically against the back of front panel 31 and divider lock mechanism 113 will be positioned to receive and hold a brochure compartment divider 85, described below.

Front panel 31 has its second side 41 connected to second side panel 51 at its first side 57. Second side panel 51 also has a top 55, a bottom 61 and a second side 59, as well as a front 53 and a back (not shown). Bottom 61 of second side panel 51 has flap 63 connected thereto.

Second side 59 of second side panel 51 is connected to first side 79 of second back panel 71. Second back panel 71 has a top 75, bottom 77, first side 79, second side 81 and back 73 (front not shown).

First back panel 3 has an assembly locking tab 99 that is a mate to receiving slot 83 of second back panel 71. Note also that first back panel 3 includes a rear stand brace 101 with a locking flap 103. This is very similar to well known stands found on the backs of many picture frames. If it is desired to place brochure holder 1 on a horizontal surface, then rear stand brace 101 is pulled out 90° and locking flap 103 is locked into it to make a stand. If vertical hanging is desired, the stand arrangement is not used and orifices 91, 93, 95, and 97, which will coincide when assembled, create two openings to hang on screws, nails or hooks on a vertical surface.

Figure 2:
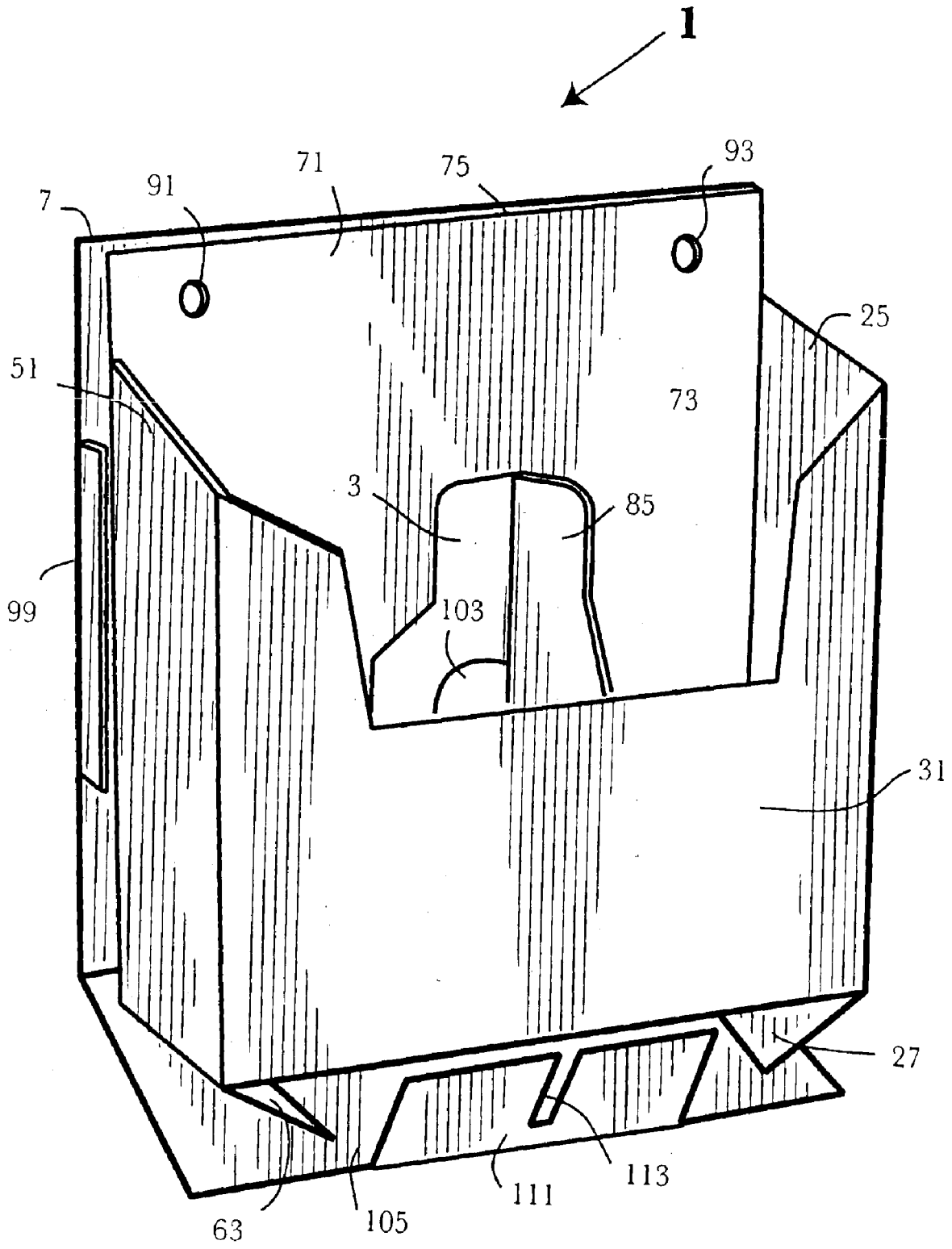
FIG. 2 illustrates an oblique, front view of the brochure holder of FIG. 1 in its partially assembled state.
Figure 3:
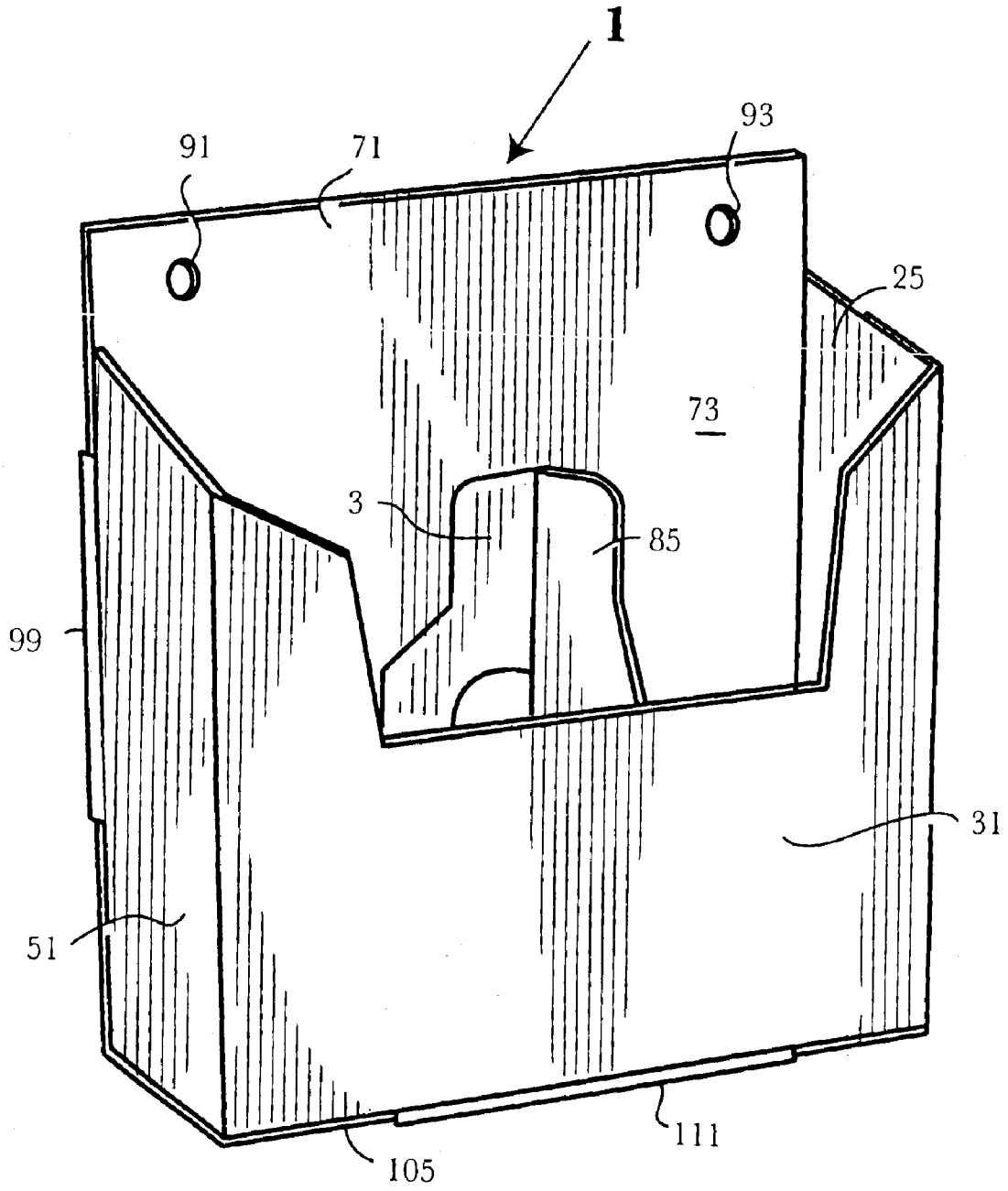
FIG. 3 shows an oblique front fully assembled view of the present invention brochure holder of FIGS. 1 and 2.

Referring to FIGS. 1, 2 and 3, identical parts are identically numbered. There three figures taken together show assembly of brochure holder 1. More specifically, first back panel 3 is swung around behind front panel 31 and second back panel 71 is also swung around behind front panel 31 and positioned in front of the first back panel 3. This exposes a brochure compartment divider 85 frontwardly and exposes a rear stand brace 101 rearwardly. Thus, a brochure compartment divider 85 can be swung from a flat closed position to an open position to have a single brochure holder or a side by side brochure holder.

When first back panel 3 and top 7 are folded as described assembly locking tab 99 is inserted into slot 83. This inherently folds first side panel 25 and second side panel 51 to be at right angles to front panel 31 and to both back panels. Flaps 27 and 63 are next folded up, second flap 43 is then folded up, bottom panel 105 is folded up and tongue flap 111 is inserted into slot 38. Alternatively, flaps 27 and 63 may be folded up after second flap 43 is folded up, as shown in FIG. 2. FIG. 3 shows a brochure holder 1 in its fully assembled form with brochure compartment divider 85 open and fitted into divider lock mechanism 113 for side by side double brochure stacking.

Figure 4:
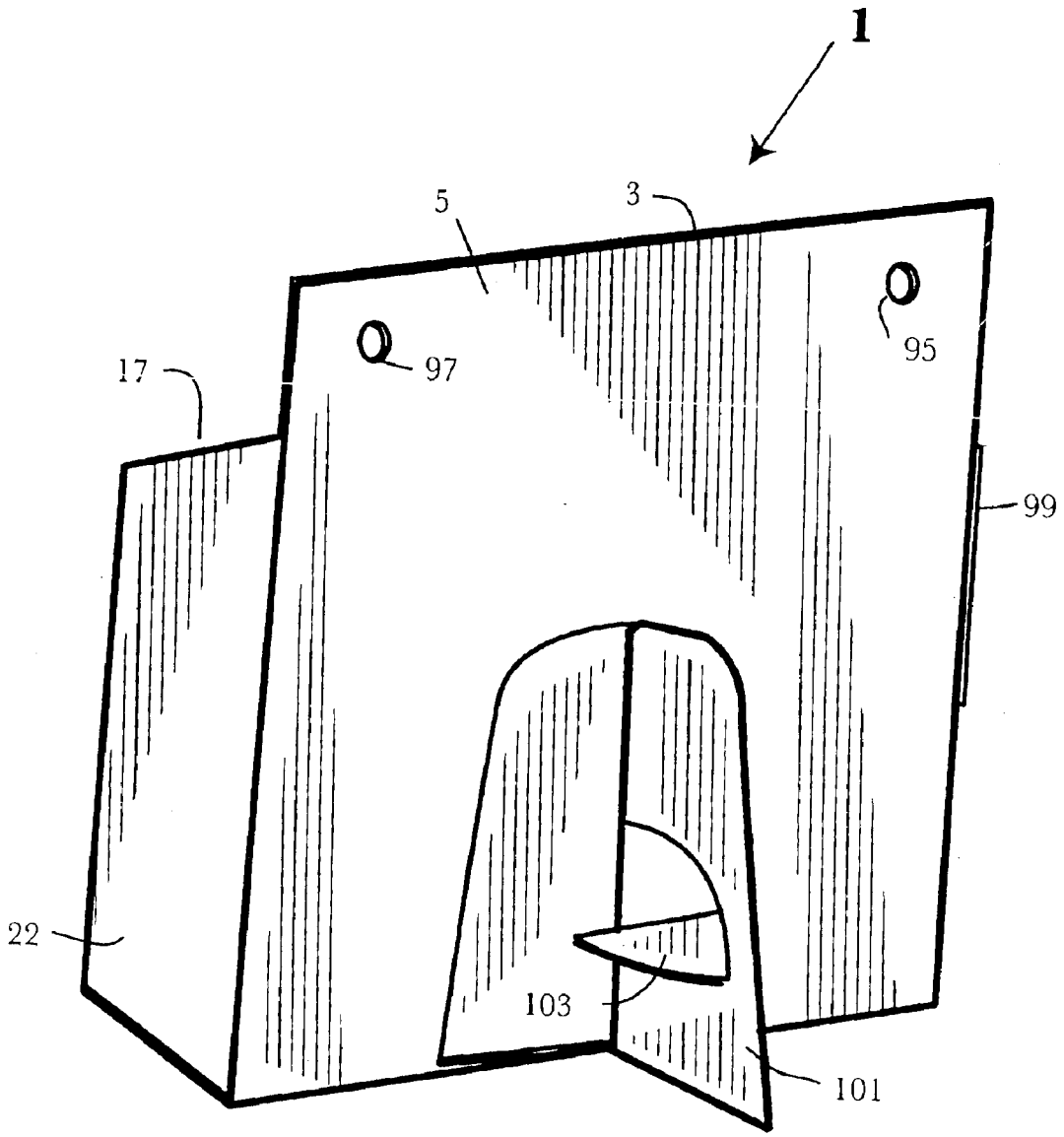
FIG. 4 shows a back view thereof.

FIG. 4 shows a back view of the fully assembled brochure holder 1 shown in FIG. 3 with like parts being identically numbered.

Figure 5:
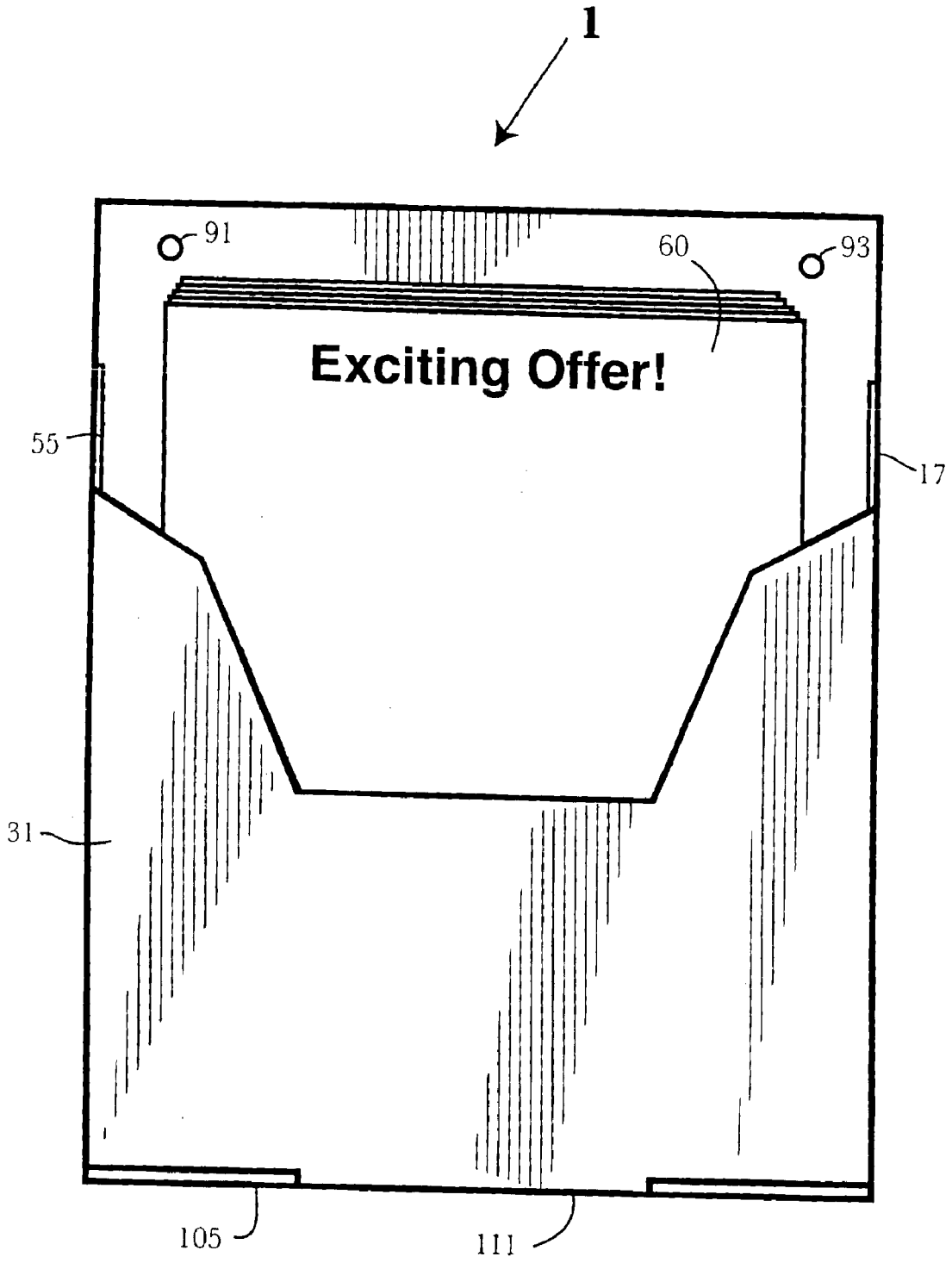
FIG. 5 shows a front view of the present invention brochure holder above, with its compartment divider closed to accommodate a single stack of large brochures.
Figure 6:
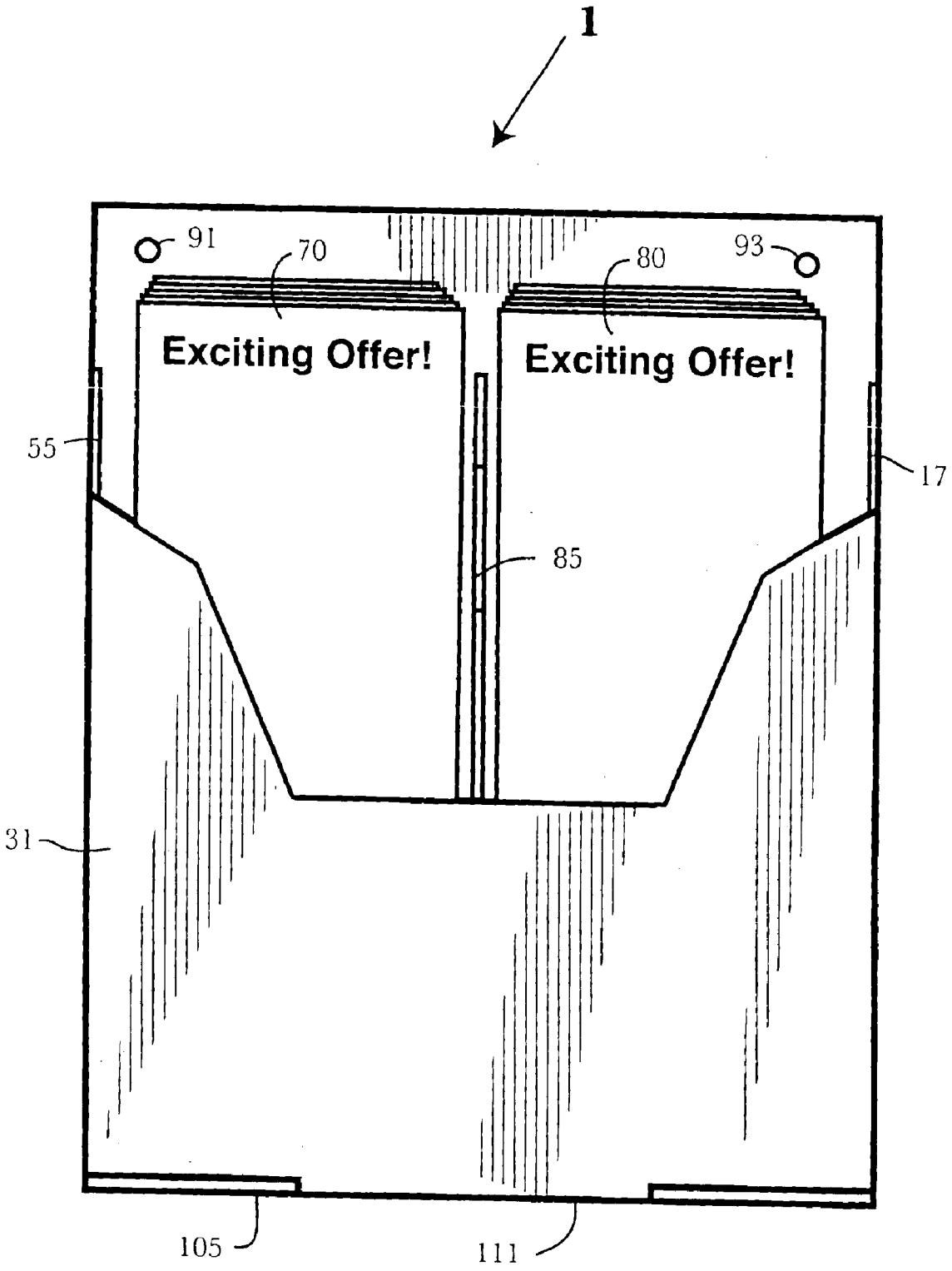
FIG. 6 shows a front view of the present invention brochure holder above, with its compartment divider open to accommodate two side by side stacks of smaller brochures.

FIGS. 5 and 6 show the present invention fully assembled brochure holder 1 above, with identical parts again being identically numbered. FIG. 5 shows the compartment divider closed with full sized brochure sheets 60 contained therein, while FIG. 6 shows holder 1 with compartment divider 85 fully deployed, creating two compartments, one for brochures 70 on the left, and the other for brochures 80 on the right.

Figure 7:
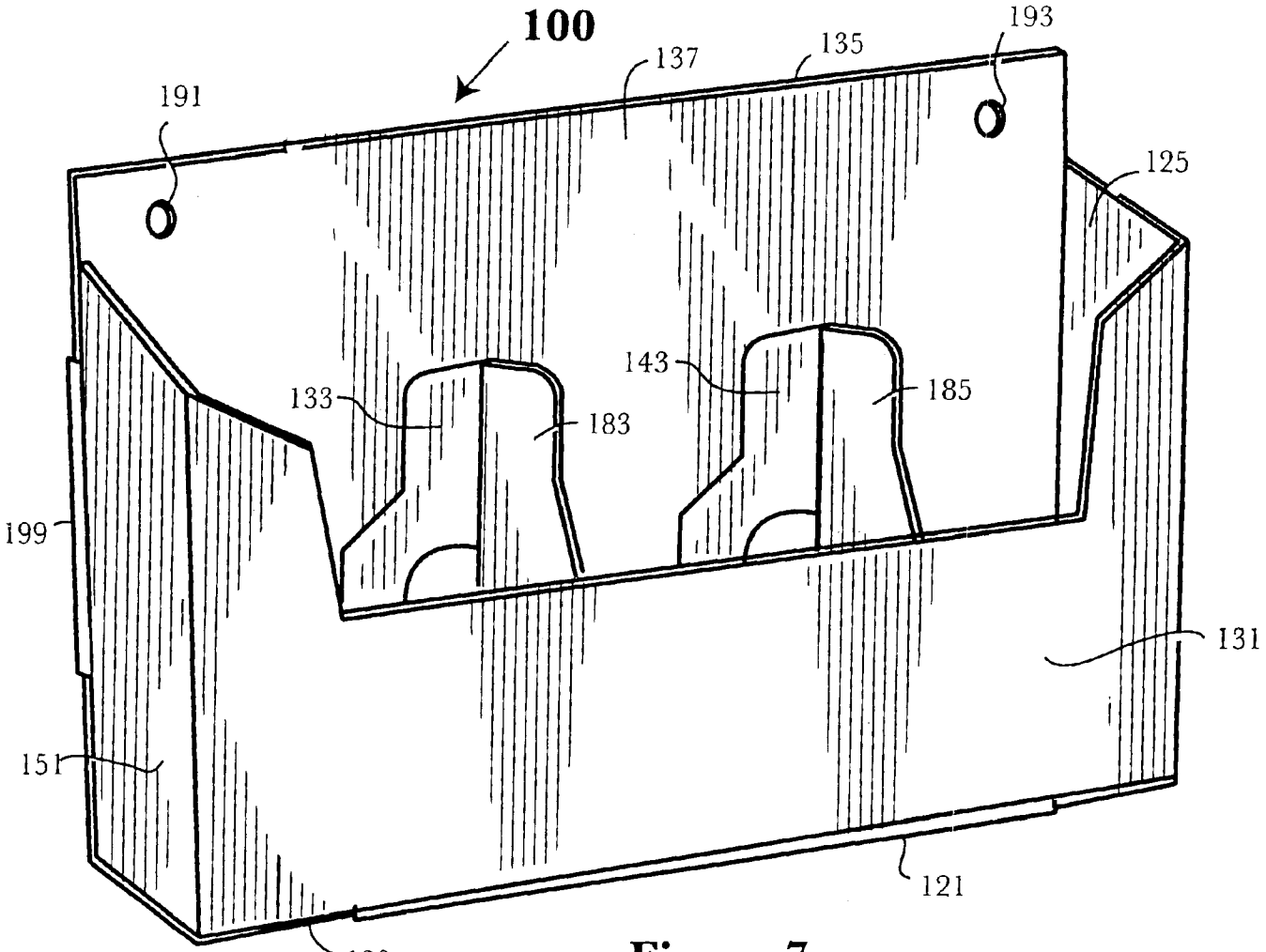
FIG. 7 shows an alternative embodiment present invention brochure holder with plural dividers.

FIG. 7 shows another embodiment one piece adjustable size brochure holder 100. It has a first back panel 137 and a second back panel 135, side panels 125 and 151, and front panel 131. It is assembled in a manner as described above with respect to holder 1 in the foregoing figures, using flaps 121 and 199. However, instead of a single compartment divider, as above, this holder 100 has two dividers 183 and 185, with behind panel sections 133 and 143, as shown. This enables a user to have none, one or both dividers open to accommodate very large, or one larger, one smaller, or three small brochures, respectively.

Many variations may be made without exceeding the scope of the present invention. For example, the connections of each of the panels may be perforated or scored in preferred embodiments to make folding and assembly easier. Also, the brochure holder may be made of plastic, cardboard or other material, or combinations thereof such as, plastic-coated cardboard or laminate material. Not all the flaps are necessary in every embodiment, although the preferred embodiments would at least have bottom panel 105 with tongue flap 111 and second flap 43. While bottom panel 105 is shown to be connected to first back panel 3 it could be connected to either side panel or the front panel 31 with second flap 43 and the smaller flaps being connected to different panels. Also, the shape, height, depth, width, and panel thicknesses could be different. Further, more than one compartment divider could be included so as to permit three or more side by side stockings. For example, a present invention brochure holder with two dividers could be used with both compartment dividers closed for a single brochure, both dividers open for three smaller brochures, such as trifold brochures, or with one open and one closed to accommodate one large brochure and one smaller brochure.

Obviously, numerous modifications and variations of the present invention are possible in light of the above teachings. It is therefore understood that within the scope of the appended claims, the invention may be practiced otherwise than as specifically described herein.

What is claimed is:

1. A one piece, adjustable size brochure holder, which comprises:

a.) a first back panel, said first back panel having a front surface, a back surface, two sides, a top and a bottom;

b.) a first side panel having a front surface, a back surface, a first side and a second side, a top and a bottom, said first side panel being connected at its first side to a side of said first back panel;

c.) a front panel having a front surface and a back surface, having a first side and a second side, a top and bottom, said first side of said front panel being connected to said second side of said first side panel;

d.) a second side panel having a front surface, a back surface, a first side and a second side, a top and a bottom, said second side panel being connected at its first side to said second side of said front panel;

e.) a second back panel, said second back panel having a front surface, a back surface, a first side and a second side, a top and a bottom, said second back panel being connected at its first side to said second side of said second side panel;

f.) a bottom panel connected to one of said first back panel, said first side panel, said front panel, said second side panel, and said second back panel at its bottom, said bottom panel having an extended vertical flap adapted to be positioned vertically upwardly at about 90° from said bottom panel, said vertical flap having a divider lock mechanism formed thereon;

g.) a brochure compartment divider located on and partially cut from one of said first back panel and said second back panel, said brochure compartment divider having a first position, being a closed position, in the same plane as a back panel on which it is located, so as to create a single brochure holder compartment, and a second position, being an opened position, in a plane approximately at about 90° to a back panel on which it is located, and when in said second position, being fitted into said divider lock mechanism of said vertical flap so as to create two brochure holder compartments;

wherein said first back panel and said second back panel may be brought to coincide against one another, and said bottom panel may be attached to at least one of said first back panel, said first side panel, said front panel, said second side panel, and said second back panel to create an open top brochure holder, and wherein said brochure compartment divider may be in said first position such that said brochure holder may accommodate a single stack of brochures, and wherein said brochure compartment divider may be in said second position such that said brochure holder may accommodate two side-by-side separate stacks of brochures.

2. The one piece, adjustable size brochure holder of claim 1 wherein said brochure compartment divider is located on said first back panel.

3. The one piece, adjustable size brochure holder of claim 2 wherein said second back panel contains a partially cut pull-out support stand.

4. The one piece, adjustable size brochure holder of claim 1 wherein said bottom panel is connected to one of said first back panel, said front panel, and said second back panel.

5. The one piece, adjustable size brochure holder of claim 1 wherein there is said bottom panel and a separate second bottom panel, wherein said bottom panel is connected to one of said first back panel and said second back panel, and said second bottom panel is connected to said front panel.

6. The one piece, adjustable size brochure holder of claim 1 wherein said first side panel and said second side panel each include bottom flaps connected thereto.

7. The one piece, adjustable size brochure holder of claim 1 wherein said first back panel and said second back panel include complementary interconnecting components for attachment to one another.

8. The one piece, adjustable size brochure holder of claim 7 wherein said complementary interconnecting components are a tab and receiving slot.

9. The one piece, adjustable size brochure holder of claim 1 wherein at least one said first back panel and said second back panel includes a mounting mechanism for hanging said brochure holder on a vertical surface.

10. The one piece, adjustable size brochure holder of claim 9 wherein said mounting mechanism is at least one mounting orifice.

11. A one piece, adjustable size brochure holder, which comprises:

a.) a first back panel, said first back panel having a front surface, a back surface, two sides, a top and a bottom;

b.) a first side panel having a front surface, a back surface, a first side and a second side, a top and a bottom, said first side panel being connected at its first side to a side of said first back panel;

c.) a front panel having a front surface and a back surface, having a first side and a second side, a top and bottom, said first side of said front panel being connected to said second side of said first side panel;

d.) a second side panel having a front surface, a back surface, a first side and a second side, a top and a bottom, said second side panel being connected at its first side to said second side of said front panel;

e.) a second back panel, said second back panel having a front surface, a back surface, a first side and a second side, a top and a bottom, said second back panel being connected at its first side to said second side of said second side panel;

f.) a bottom panel connected to one of said first back panel, said first side panel, said front panel, said second side panel, and said second back panel at its bottom, said bottom panel having an extended vertical flap adapted to be positioned vertically upwardly at about 90° from said bottom panel, said vertical flap having a divider lock mechanism formed thereon;

g.) a brochure compartment divider located on and partially cut from one of said first back panel and said second back panel, said brochure compartment divider having a first position, being a closed position, in the same plane as a back panel on which it is located, so as to crate a single brochure holder compartment, and a second position, being an opened position, in a plane approximately at about 90° to a back panel on which it is located, and when in said second position, being fitted into said divider lock mechanism of said vertical flap so as to create two brochure holder compartments;

h.) a plurality of perforations located at connections where each of said panels are connected to another panel to render said brochure holder easier to assemble;

wherein said first back panel and said second back panel may be brought to coincide against one another, and said bottom panel may be attached to at least one of said first back panel, said first side panel, said front panel, said second side panel, and said second back panel to create an open top brochure holder, and wherein said brochure compartment divider may be in said first position such that said brochure holder may accommodate a single stack of brochures, aid wherein said brochure compartment divider may be in said second position such that said brochure holder may accommodate two side-by-side separate stacks of brochures.

12. The one piece, adjustable size brochure holder of claim 11 wherein said brochure compartment divider is located on said first back panel.

13. The one piece, adjustable size brochure holder of claim 12 wherein said second back panel contains a partially cut pull-out support stand.

14. The one piece, adjustable size brochure holder of claim 11 wherein said bottom panel is connected to one of said first back panel, said front panel, and said second back panel.

15. The one piece, adjustable size brochure holder of claim 11 wherein there is said bottom panel and a separate second bottom panel, wherein said bottom panel is connected to one of said first back panel and said second back panel, and said second bottom panel is connected to said front panel.

16. The one piece, adjustable size brochure holder of claim 11 wherein said first side panel and said second side panel each include bottom flaps connected thereto.

17. The one piece, adjustable size brochure holder of claim 11 wherein said first back panel and said second back panel include complementary interconnecting components for attachment to one another.

18. The one piece, adjustable size brochure holder of claim 17 wherein said complementary interconnecting components are a tab and receiving slot.

19. The one piece, adjustable size brochure holder of claim 11 wherein at least one said first back panel and said second back panel includes a mounting mechanism for hanging said brochure holder on a vertical surface.

20. The one piece, adjustable size brochure holder of claim 19 wherein said mounting mechanism is at least one mounting orifice.

* * * * *